US006000148A

United States Patent [19]

Cretinon

[11] Patent Number: 6,000,148

[45] Date of Patent: Dec. 14, 1999

[54] MULTI-LAYERED SOLE COUPLED TO A REINFORCEMENT OF THE UPPER OF THE BOOT

[75] Inventor: Frederic Cretinon, Metz-Tessy, France

[73] Assignee: Salomon S.A., Metz-Tessy, France

[21] Appl. No.: 09/104,178

[22] Filed: Jun. 25, 1998

[30] Foreign Application Priority Data

Jun. 27, 1997 [FR] France ..... 97 08555

[51] Int. Cl.[6] ..... A43B 7/14; A43B 23/08

[52] U.S. Cl. ..... 36/88; 36/92; 36/69

[58] Field of Search ..... 36/88, 91, 92, 36/69

[56] References Cited

U.S. PATENT DOCUMENTS

| | | | |
|---|---|---|---|
| 256,030 | 4/1882 | Morton | 36/69 |
| 3,425,075 | 2/1969 | Murray | 36/69 |
| 4,255,877 | 3/1981 | Bowerman | 36/69 |
| 4,776,111 | 10/1988 | Crowley | 36/69 |
| 4,947,560 | 8/1990 | Fuerst et al. | 36/88 |
| 5,317,820 | 6/1994 | Bell et al. . | |
| 5,408,761 | 4/1995 | Gazzano | 36/88 |
| 5,465,509 | 11/1995 | Fuerst et al. | 36/88 |
| 5,498,033 | 3/1996 | Hoshizaki et al. | 36/69 |
| 5,884,420 | 3/1999 | Donnadieu | 36/69 |

FOREIGN PATENT DOCUMENTS

| | | | |
|---|---|---|---|
| 1249930 | 2/1989 | Canada . | |
| 0748596 | 12/1996 | European Pat. Off. . | |
| 1333545 | 12/1963 | France . | |
| 9213747 | 1/1993 | Germany . | |
| 9215048 | 2/1993 | Germany . | |
| 93/25107 | 12/1993 | WIPO | 36/92 |

*Primary Examiner*—M. D. Patterson
*Attorney, Agent, or Firm*—Greenblum & Bernstein P.L.C.

[57] ABSTRACT

A boot including, on the one hand, a bottom assembly made of at least two layers, or one wearable layer and a core layer, and, on the other hand, a reinforcement element which is coupled to the core layer of the bottom assembly, wherein the reinforcement element is coupled to the core layer in a region located between the heel and the fore end of the bottom assembly, and it extends freely along at least one side of the upper into the rear region, and wherein a comfort layer is inserted between the user's foot and the core layer. The boot provides excellent lateral foot retention without there being any interference with shock absorption on the comfort layer, and this is achieved while allowing the heel of the bottom assembly free to bend.

17 Claims, 3 Drawing Sheets

Fig 6
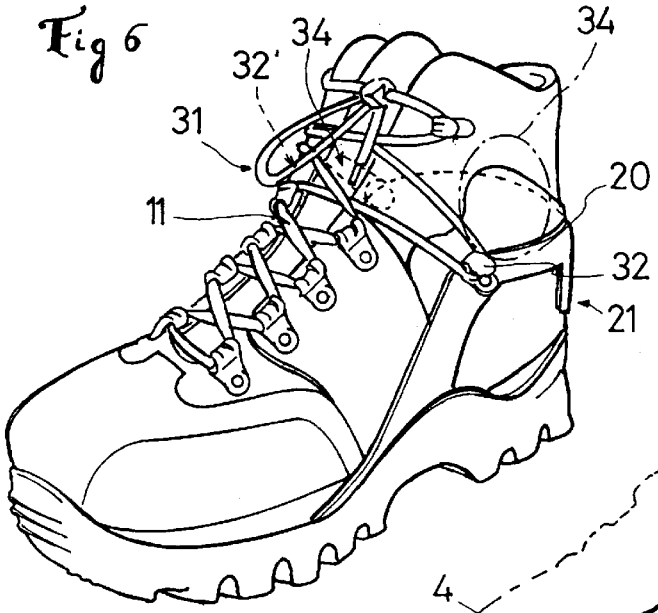
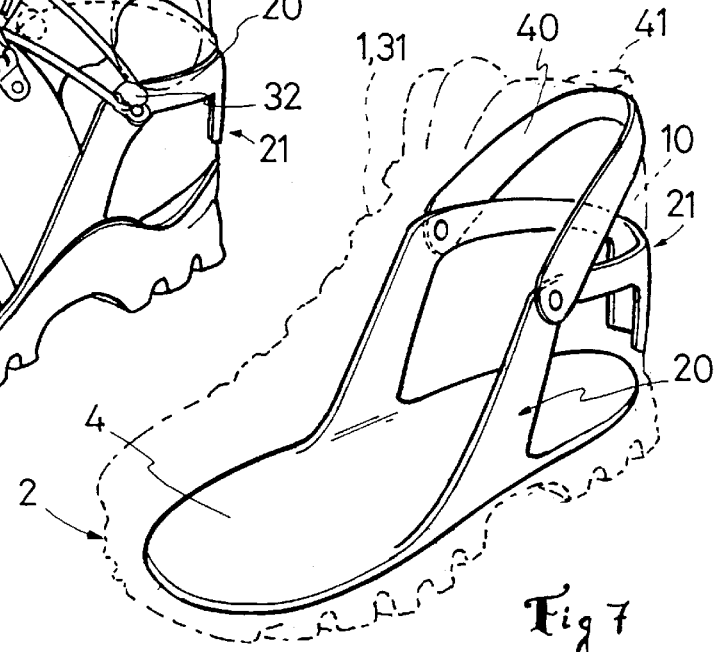
Fig 7
Fig 9
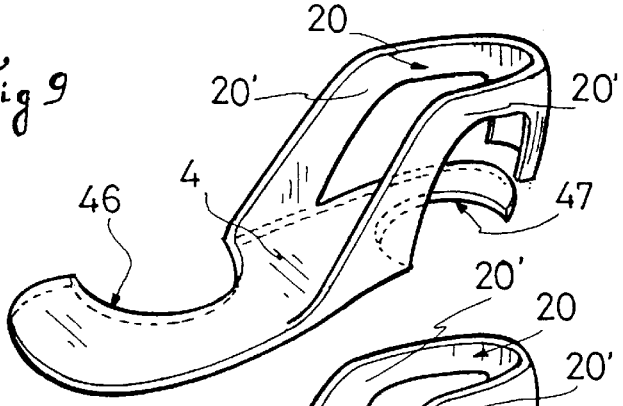
Fig 8
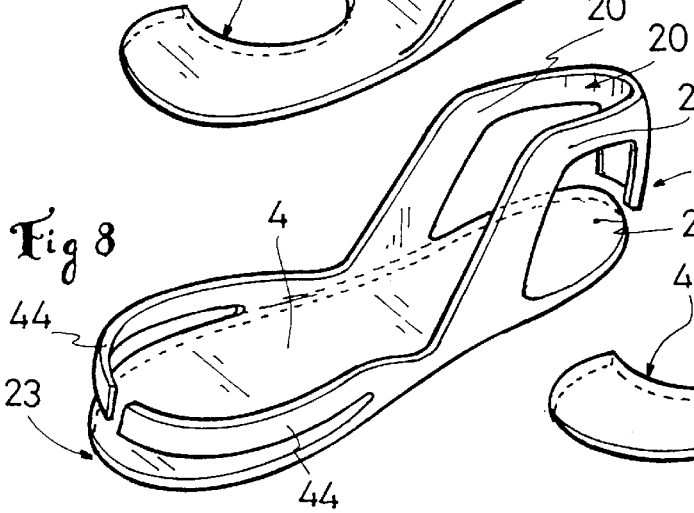
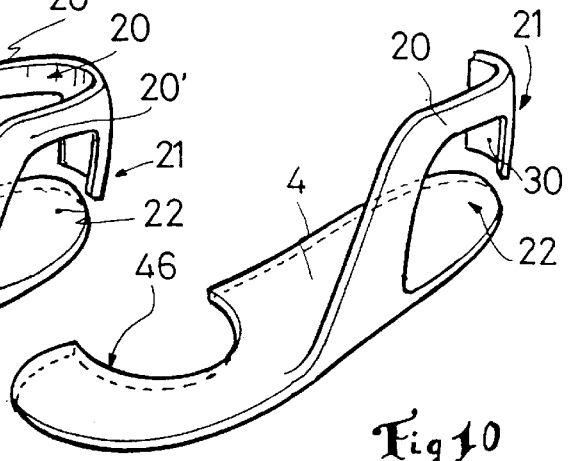
Fig 10

MULTI-LAYERED SOLE COUPLED TO A REINFORCEMENT OF THE UPPER OF THE BOOT

BACKGROUND OF THE INVENTION

1. Field of the Invention

This invention is related to boots whose bottom assembly is made according to a stratified structure having several layers, each fulfilling a separate function. More specifically, this invention is related to the coupling of a reinforcement element of the upper with one of the layers of the bottom assembly.

2. Description of Background and Relevant Information

Boots of the aforementioned type have been described in U.S. Pat. No. 5,317,820 and published European Application No. 0 748 596. More specifically, in the example of U.S. Pat. No. 5,317,820, the reinforcement element of the boot upper is coupled to a bottom assembly that includes, from the base upwards:

- a wearable layer, made of rubber, that comes in contact with the ground;
- an intermediate layer, made of rubber, having a lateral edge that extends rearwardly in order to retain the user's heel; and
- another semi-stiff upper layer, made of a plastic material, that extends in correspondence with the plantar surface of the user's foot.

According to the construction disclosed and taught, it is from this latter upper layer, made of a plastic material, that the reinforcement element originates, the element being constituted of two lateral supports rising up the sides of the upper of the boot.

By virtue of this structure, the semi-stiff upper layer, which constitutes the core of the sole, can be biased so as to vary in position with respect to the ground depending on the forces applied on the upper by means of the lateral supports that form the reinforcement element thereof. As a result, this reinforcement element supports the forces borne by the upper, especially during use, and transmits them directly to the bottom assembly of the boot via the semi-stiff upper layer from which it originates, and vice versa.

In fact, by obtaining the coupling of the reinforcement element with the semi-stiff upper layer, the upper and the bottom assembly become interdependent, thereby improving the lateral retention of the user's foot in the boot, and thus the stability of the shod foot. However, the efficiency of this coupling has proven to be random, or at least inadequate when it comes to achieving good adherence and efficient gripping, since the stiffness obtained in the area of the wearable layer which comes in contact with the ground, or at the bottom assembly-ground interface level, depends not only on the mechanical properties of the semi-stiff upper layer with its reinforcement, but also depends on the mechanical properties of the intermediate rubber layer that is inserted between it and the wearable layer. As regards the intermediate rubber layer, which is inherently shock absorbing, and also adds material thickness to the bottom assembly on the side that is furthest from the plantar surface of the user's foot, there is a substantial dispersion of shocks and stresses in this area, and elastic deformations also occur, which have a detrimental effect on the expected lateral retention of the foot, by means of the reinforcement element, and therefore on the stability during the impact of the bottom assembly with the ground. The precision of the supports of the bottom assembly on the ground are also changed.

In addition, another disadvantage lies in the fact that the semi-stiff upper layer is located immediately across from the plantar surface of the user's foot.

Indeed, in such a situation where the foot takes direct support on a relatively hard surface, the repeated compressions that the latter is subject to at the point of such supports when the boot is used often causes painful sensations, even minute traumas, that are manifested, for example, by chafing, blisters, cramps, etc.

In the example of European Application No. 0 748 596, the boot disclosed therein differs from the previously described boot mainly in the fact that the bottom assembly does not have a shock absorbing upper layer, or comfort layer, between the semi-stiff upper layer provided with the reinforcement element and the wearable layer that comes in contact with the ground. Indeed, the boot includes, on the one hand, a bottom assembly that is obtained according to a stratified structure having several layers respectively fulfilling distinct functions, or at least one wearable layer and one core layer, and, on the other hand, one reinforcement layer for its upper that is coupled to that of the layers of the bottom assembly that constitutes its core layer, the latter being directly arranged on the wearable layer that comes in contact with the ground. The overall structure which results from such an arrangement provides greater efficiency to the coupling of the reinforcement element with the upper layer, which are preferably made from an injected plastic material, and therefore equipped with a certain stiffness.

Indeed, according to this construction, there is no dispersion of shocks and stresses between the wearable layer that comes in contact with the ground and the upper layer that constitutes the core of the sole and is provided with the reinforcement element. Consequently, all the biases and stresses that occur between the reinforcement element and the intermediate layer from which the latter originates are directly transmitted to the wearable layer that comes in contact with the ground and vice versa. As such, there is optimal synergy between the reinforcement element of the upper and the bottom assembly which allows for a substantial improvement in the overall behavior of the boot in dynamic gripping and adherence onto the ground, as well as in precision and stability, especially by virtue of the stiffness in torsion and bending achieved in the bottom assembly/ground interface obtained in this manner.

However, such a bottom assembly, i.e., with no intermediate shock absorbing layer or comfort layer, has proven to be especially ill-suited in ensuring a transfer function capable of correctly dampening shocks in the area of the user's foot at each contact with the ground, i.e., there is no shock absorption. Such a transfer function with shock absorption is essential in the bottom assembly for a good foot movement, which generally occurs in three phases, absorption-support-propulsion, and prevents certain types of traumas that almost always occur due to the intensity of the shocks and their frequency in the sensitive zones of the plantar surface of the foot, such as, for example, the heel zone where overloads are substantial.

Indeed, in some sports, such as hiking, especially when walking down a slope, or in sports such as running, the heel of the boot hits the ground rather violently at the moment of impact and the reactional forces from the ground can reach values that are equal to several times the user's body weight.

Therefore, it is easy to understand that the absorption function of the bottom assembly is especially important during this first phase of the foot movement, so as to absorb at least part of the shock energy that is produced at that moment and disperse it through elastic deformation, and thus avoid overloads that generate injuries.

In addition, as was the case with the bottom assembly described previously with reference to U.S. Pat. No. 5,317, 820, the upper layer that constitutes the core of the sole is immediately across from the plantar surface. Consequently, the same problems of discomfort are also found in the foot/sole interface.

SUMMARY OF THE INVENTION

It is an object of the instant invention to overcome the disadvantages of the aforementioned boots, and to this end it proposes:

making the reinforcement of the upper and the bottom assembly interdependent so as to improve the stability of the foot in view of proper movement thereof, the precision of the supports in the bottom assembly/ground interface, and the grip of the wearable layer of the bottom assembly on the ground by making it more incisive;

dampening the shocks during the impact of the bottom assembly with the ground without altering the foot stability;

guaranteeing an optimum comfort level in the foot/bottom assembly interface without cutting off the necessary perception of the bottom assembly supports on the ground;

restoring a portion of the energy used during shock absorption so as to stimulate rebound during the movement of the foot, at least during the propulsion phase.

In order to achieve these objectives, the boot according to the invention includes, on the one hand, a bottom assembly obtained according to a stratified structure having several layers, or at least one wearable layer and one core layer respectively fulfilling distinct functions, and, on the other hand, a reinforcement element for the upper that is coupled to that of the layers of the bottom assembly that constitutes its core layer, the latter being arranged directly on the wearable layer that comes in contact with the ground.

The reinforcement element is coupled to the core layer of the bottom assembly in an area located between the heel and the fore end of the bottom assembly, and it extends from this area over at least one side of the upper, being spread from the bottom assembly until it reaches the area located across from the heel of the latter, and wherein a shock absorbing and elastic comfort layer is interposed between the upper and the core layer of the bottom assembly.

According to a preferred embodiment, the reinforcement element extends freely with respect to the sides of the upper.

According to this construction, the boot thus made has:

an efficient coupling of the reinforcement element and the core layer of the bottom assembly with the wearable layer in contact with the ground because the reinforcement of the upper is made interdependent of the bottom assembly without there being any interference with an intermediate shock absorbing layer;

an extremely good shock absorption in the bottom assembly/ground interface because the spacing of the reinforcement element with respect to the heel of the bottom assembly leaves the heel free to bend during impacts with the ground, which furthermore respects satisfactory foot movement during the shock absorption phase;

a good absorption of shocks because such shocks are dispersed, and thus dampened, firstly, at the level of the wearable layer; secondly, in the area of the core layer, which, due to its stiffness in torsion and bending, disperses them even further over almost its entire surface; and thirdly, in the area of the comfort layer, which dampens their residual intensity even further, before they reach the foot;

an optimum level of comfort in the bottom assembly/foot interface because the plantar surface of the foot rests directly on an elastic shock absorbing layer that ensures a flexible contact especially in the area of the foot supports;

a certain capacity to stimulate rebounding during the movement of the foot because, on the one hand, the elastic shock absorbing layer, by its very nature, pushes the foot back in order to readopt its initial shape in the manner of an elastic return during the movement of the foot during the propulsion phase, and, on the other hand, due to the bending freedom of the heel of the bottom assembly with respect to the reinforcement of the upper, the elastic return into the initial position of the latter leads to the same rebound effect.

BRIEF DESCRIPTION OF THE DRAWINGS

The invention will be better understood and other features will become more apparent from the description that follows, with reference to the attached schematic drawings, that show by way of non-restrictive examples several embodiments wherein:

FIG. 6 is a perspective view of a boot similar to the one in FIGS. 1–5, but whose reinforcement element is equipped with gripping means cooperating with the closure system of the boot;

FIG. 7 is a perspective view showing an embodiment where an additional reinforcement element is adapted on the reinforcement element that is coupled to the core layer of the bottom assembly, still according to the invention;

FIGS. 8, 9 and 10 represent, in perspective views, several possible constructions of the reinforcement coupled to the core layer of the bottom assembly.

DETAILED DESCRIPTION OF THE INVENTION

Figure 1:
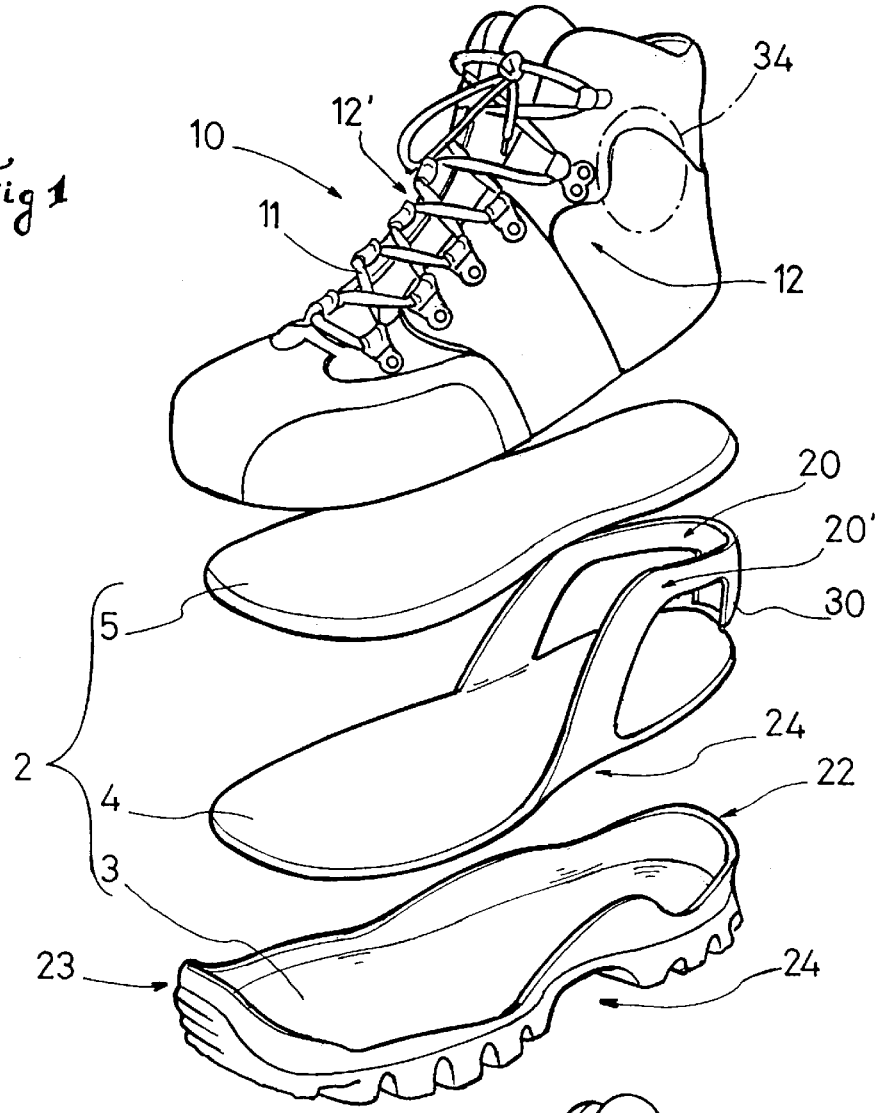
FIG. 1 shows, in an exploded perspective view, the construction of a boot including a reinforcement element of the upper coupled to the core layer of the bottom assembly according to the invention.
Figure 2:
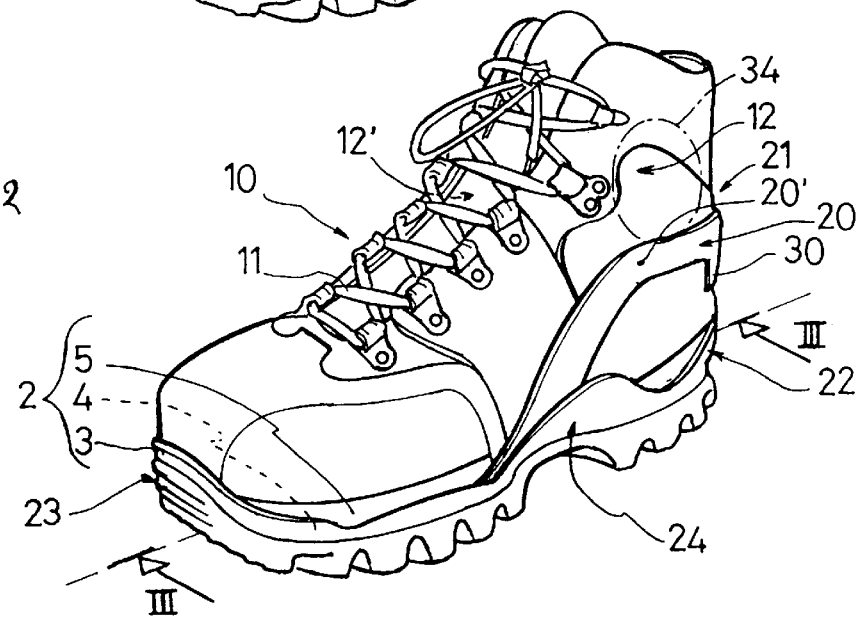
FIG. 2 shows the boot of FIG. 1, after it has been assembled together.

The boot 1, shown by way of example in FIGS. 1 and 2, generally includes an upper 10 assembled to a bottom assembly 2 made according to a stratified structure, and a reinforcement element 20 for the upper 10, coupled directly to the bottom assembly 2. In a known manner, the upper 10 has an opening for the passage of the foot, and a tightening-closure system 11, such as a lacing, enabling the adaptation of the shodding volume of the boot 1 to the foot; its assembly with the bottom assembly 2 is made, after fitting into the reinforcement element 20, by using conventional assembly techniques, such as gluing, welding, stitching, crimping, etc., the reinforcement element 20 being preferably left free with respect to its wall, especially in the region 21 that corresponds to the rear zone of the user's foot, and that is located across from the heel 22 of the bottom assembly 2;

however, it can also be totally integrated with the upper, for example, by stitching.

The latter has a stratified structure wherein:

a wearable layer 3, having properties of flexibility, adherence and a resistance to abrasion, is adapted to come in contact with the ground;

a core layer 4, having specific properties of stiffness, is arranged directly on the wearable layer 3 so as to ensure, on the one hand, the dispersion over almost its entire surface of the shock waves that cross the wearable layer 3, and to provide, on the other hand, the bottom assembly 2 with the features for adhering and gripping onto the ground;

a shock-absorbing and elastic comfort layer 5 is interposed between the core layer 4 and the upper so as to dampen the intensity of the shock waves transmitted by the core layer 4 so as to provide a certain level of comfort in the area of the foot supports, by virtue of its flexibility, along with stimulating a rebound effect during the movement of the foot.

According to the invention, the reinforcement element 20 is coupled to the core layer 4 of the bottom assembly 2 in the region 24 located between the heel is rearward end 22 and the foreward end 23 thereof, substantially in correspondence with the plantar arch of the user's foot because this region remains practically unbiased in bending during the movement of the foot; it extends along each side 12, 12' of the upper 10, from this region 24, becoming spaced from the bottom assembly 2 until it reaches the region 21 of the heel 22 thereof, which gives it the general shape of a strip having an arched arm 20' directed substantially parallel to the bottom assembly 2 in the region 21 of the heel 22. This feature that is relative to the coupling of the reinforcement element 20 with the core layer 4 of the bottom assembly 2 is combined with the interpositioning of the comfort layer 5 between the core layer 4 and the upper 10, or between the user's foot and the core layer 4. The resulting combination enables a lateral stiffening of the boot without disturbing its shock absorption capacity and the proper movement of the foot. Indeed, as shown mainly in FIGS. 3 and 4, the heel 22 of the bottom assembly 2 remains free to bend as indicated by the arrow 27 during the impact of the bottom assembly 2 with the ground 26, because the reinforcement element 20 extends at a distance from the bottom assembly 2 in the region 21 corresponding to the rear portion of the user's foot 50. In addition, the user's foot 50 retains the potential of being dampened by the comfort layer 5 since it is located directly thereabove.

Figure 5:
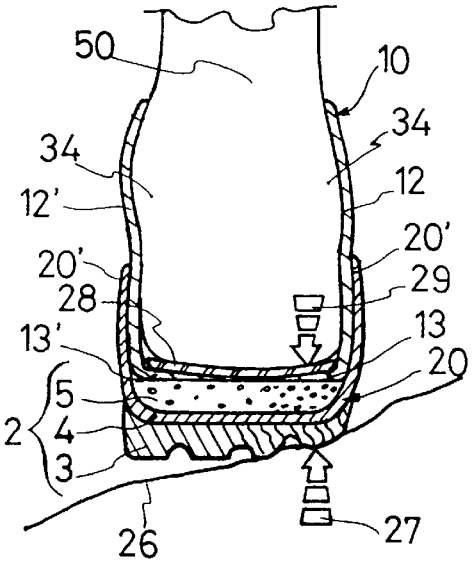
FIG. 5 is a transverse sectional view of the boot taken along the line IV—IV of FIG. 3 and shows how the reinforcement element participates in the lateral retention and the stability of the foot.

The embodiment according to which the reinforcement element 20 extends freely along the sides 12, 12' of the upper 10 covers an important feature when the upper 10 is, for example, mounted by adhesion or stitching to an insole 28 by means of flaps 13, 13' extending from the sides 12, 12', such as represented in FIG. 5, before being assembled to the bottom assembly 2. Indeed, in this type of assembly, the sides 12, 12' of the upper 10 are fixed to the insole 28 with such firmness that they are forced to follow almost all the relative displacements thereof with respect to the comfort layer 5 on which it is fixed.

Figure 3:
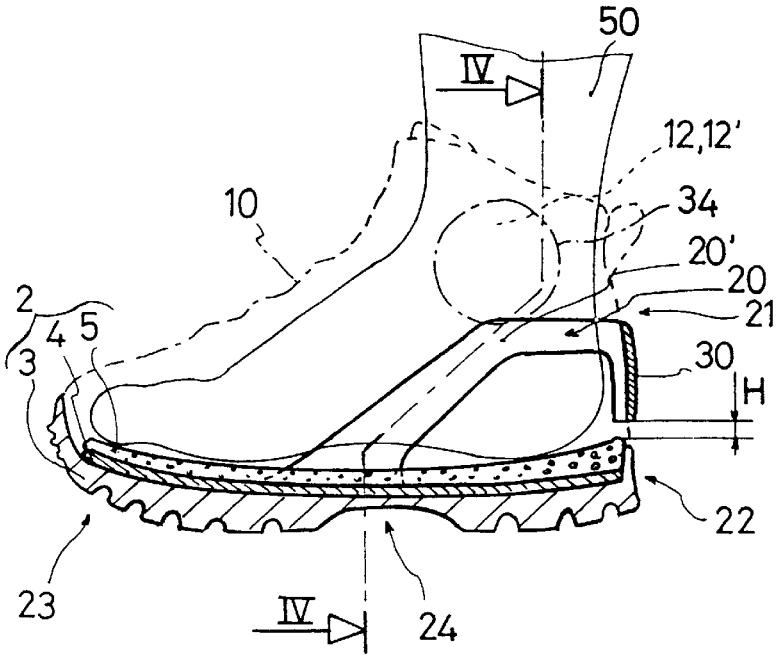
FIGS. 3 and 4 are longitudinal sectional views of the boot of FIG. 2, taken along the line III—III, schematically showing the shock absorption at the heel during the impact of the bottom assembly with the ground.

Depending on the desired shock absorption and/or flexibility features, the relative displacement of the sides 12, 12' with respect to the reinforcement element 20 can advantageously be limited in amplitude, especially in the rear region 21 in the heel area 22 of the bottom assembly 2. In the present embodiment, the reinforcement element 20 is provided to this end with a substantially vertical tab 30 that extends in the direction of the bottom assembly 2 across from the heel 22 of the latter. A free space having a value H, predetermined by the construction, as seen in FIG. 3, remains present, while at rest, between the free end 30' of the tab 30 and the bottom assembly 2.

Figure 4:
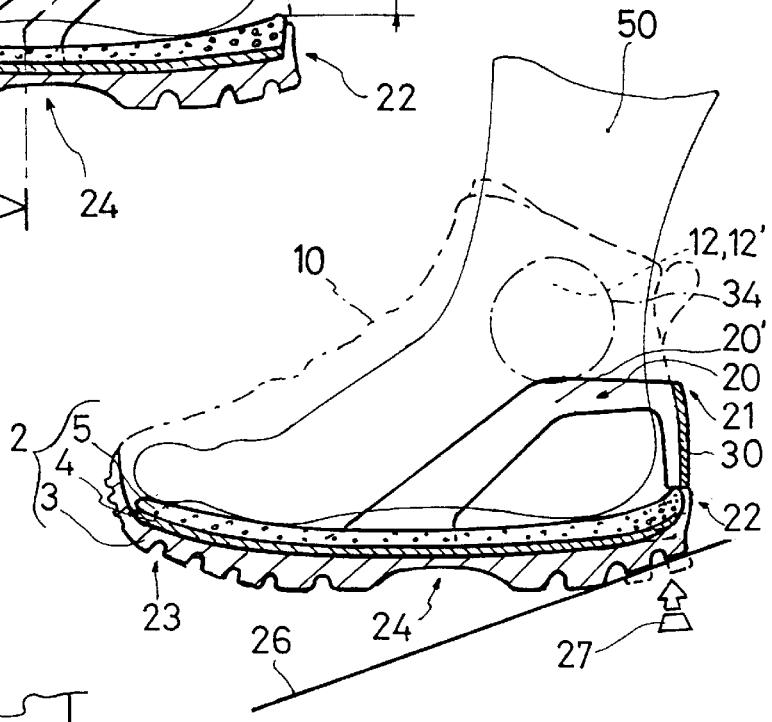

Thus, during the impact of the bottom assembly 2 with the ground 26, as shown in FIG. 4, the heel 22 bends freely in the direction of the reinforcement element 20 while dampening the intensity of the shock resulting from the impact, and this occurs during the reduction of the free space H. If the intensity of the shock is such that it was not completely absorbed during this bending of the heel 22, the latter comes into abutment against the free end 30' of the tab 30, which, by virtue of its stiffness and its attachment to the reinforcement element 20, blocks it in its bending movement. These arrangements thus ensure a bottom assembly 2 whose behavior varies, from a predetermined intensity threshold of the shocks that result from the impact of the bottom assembly 2 with the ground 26, both in its dampening ability as well as its bending ability.

In addition, the reciprocal displacement freedom given to the sides 12, 12' of the upper 10 and to the reinforcement element 20, as shown in FIG. 5, maintains the lateral retention and also the stability of the foot 50 when dampening is obtained simply by the elastic deformation of the comfort layer 5. Indeed, in such a case, the foot 50 compresses, by the support reaction, the comfort layer 5 such as indicated by the arrow 29 and becomes relatively lowered with respect to the arched arm 20' of the reinforcement element 20 on each side 12, 12' of the upper 10. As such, the reinforcement element 20 nests the user's foot 50 even further. It is clear that this effect is all the more sensitive when the reinforcement element 20 extends continuously along the upper 10, from one side 12 to the other 12' whilst outlining the rear region 21 of the user's foot as is the case in the instant embodiment. According to some details, each arched arm 20' of the reinforcement element 20 outlines the region 34 of the malleoli of the user's foot 50 from underneath. Other embodiments are possible including, in particular, one in which the arched arm 20' of the reinforcement element 20 could outline the malleoli region 34 from above. Furthermore, the reinforcement element 20 having the general shape of a strip can include, at least along one side 12 or 12' of the upper 10 of the boot 1, at least two arched arms 20' that outline the region 34 of the malleoli, one arm 20' passing from underneath and the other from above.

In FIG. 6, the boot 31 is similar to the boot of FIGS. 1–5, except for the fact that hooking means 32, 32', for example, lacing hooks, are attached on the reinforcement element 20 in order to cooperate with the retention and closure system 11. For reasons of efficiency, these hooking means are located in the vicinity of the region 35 corresponding to the girth of the user's instep. Thus, when the closure system 11 is tightened, the heel of the user's foot is clearly set back against the nesting constituted by the entire rear portion of the boot 31, including the reinforcement element portion 20 that outlines the rear region 21.

Other embodiments of the reinforcement element 20 coupled to the core layer 4 of the bottom assembly 2 can also be envisioned according to the invention.

Thus, in FIG. 7, for example, the reinforcement element 20 that is coupled to the core layer 4 of the bottom assembly 2 of the boot 1 or 31, shown in dotted lines, is equipped with another reinforcement element 40, having the general shape of a stirrup, which is pivotally mounted. This second reinforcement element 40 extends along the upper portion 41 of the upper 10 of the boot 1, 31, and surrounds the rear region 21 of the user's foot.

According to another embodiment shown in FIG. 8, the reinforcement element 20 coupled to the core layer 4 of the bottom assembly 2 takes the form of a strip, as described previously, i.e., it has at least one arched arm 20' directed substantially parallel to the bottom assembly 2 in the region 21 of the heel 22 thereof, but it is also equipped with at least one reinforcement arm 44 directed towards the fore end 23 of the bottom assembly 2 (not represented), the arm 44 at least partially surrounding the fore region of the user's foot. The reinforcement arm 44 of the element 20 thus reinforces the upper of the boot frontwardly, while protecting the foot from lateral and frontal shocks, in the manner of a stone deflector.

FIG. 9 shows another embodiment wherein the core layer 4 of the bottom assembly of the boot includes cut-outs 46, 47 at selected points, thus ensuring a direct communication between the wearable layer 3 and the comfort layer 5 of the bottom assembly 2 as seen in FIG. 1. These cut-outs 46, 47 are adapted to reflect the support reactions resulting from the contact of the bottom assembly 2 with the ground, so that they become more perceptible in certain support zones of the user's foot.

In the embodiment example represented in FIG. 10, the reinforcement element 20 coupled to the core layer 4 of the bottom assembly does not extend from one side of the upper to the other, as was disclosed in the previous embodiments, but only along one side of the upper of the boot. According to such an embodiment, the reinforcement of the upper of the boot nonetheless remains totally interdependent of the bottom assembly as targeted by the invention, and leads to the same results, obviously with a certain accentuated prevalence on that side of the boot along which the reinforcement element 20 extends. The latter extends up to the rear region 21 located across from the heel 22 of the bottom assembly (not represented) so as to clearly nest the user's foot. It can also be provided with a tab 30 adapted to limit the bending amplitude of the heel 22 during the impact of the bottom assembly with the ground, and the core layer to which it is coupled can include a cut-out 46 allowing direct communication between the wearable layer 3 and the comfort layer 5.

According to certain construction details seen in FIGS. 1–10, the core layer 4 of the bottom assembly is advantageously obtained all in one piece with the reinforcement element 20, regardless of the number of arms 20', 44 that constitute it. The core layer 4 and the reinforcement element 20 can also be made independently of each other and be thereafter coupled together in the region 24 located between the heel 22 and the fore end 23 of the bottom assembly 2 by known assembly methods such as riveting, gluing, welding, etc.

Furthermore, the embodiments shown with reference to FIGS. 1, 2, 6, and 5 have the reinforcement element 20 in substantial projection along the sides 12, 12' of the upper 10 of the boot 1, 31. It can, however, be embedded in the wall thickness of the sides 12, 12', and/or be covered with a lining fabric that masks it completely or partially on the upper 10.

In addition, the reinforcement element 20 can be affixed to the sides 12, 12' of the upper 10, for example, by stitching, gluing, welding, etc., without, however, leaving the scope of the invention; indeed, in this type of construction, the reinforcement element 20 would be used in the manner of a bending beam that participates in the shock absorption by slowing the lowering of the upper 10 in the direction of the bottom assembly 2.

Finally, the invention finds its application in boots of all types, and can therefore be applied to conventional walking boots or to sports boots adapted for hiking, mountain climbing, running, skiing, etc., as well as to boots adapted to be attached to rolling motion apparatuses, such as, for example, roller skates, in-line skates, and/or gliding motion apparatuses, such as ice skates or snow skates.

The instant application is based upon the French priority patent application No. 97 08555, filed on Jun. 27, 1997, the disclosure of which is hereby expressly incorporated by reference thereto, and the priority of which is hereby claimed under 35 USC 119.

What is claimed is:

1. A boot comprising:

an upper;

a bottom assembly secured to said upper, said bottom assembly including a forward end and a rearward end, said bottom assembly having a stratified structure made of several layers, said several layers including:

at least one wearable layer for contact with the ground;

at least one core layer directly positioned on said wearable layer, said wearable layer and said core layer fulfilling respectively distinct functions; and a shock-absorbing and elastic comfort layer interposed between said upper and said core layer;

a reinforcement element for reinforcing the upper, said reinforcement element being coupled to said core layer of said bottom assembly in an intermediate region located between said forward and rearward ends of said bottom assembly, said reinforcement element extending from said intermediate region along at least one of a pair of sides of said upper to a rear region corresponding to a heel of the user's foot, said reinforcement element being spaced from said bottom assembly at areas between said intermediate region and said rear region.

2. A boot according to claim 1, wherein:

said reinforcement element extends freely with respect to said sides of said upper.

3. A boot according to claim 1, wherein:

on at least one of said sides of said upper, said reinforcement element has a shape of a strip, said strip including at least one arched arm outlining a region corresponding to a malleoli of the user's foot, and extending to said rear region substantially parallel to said bottom assembly.

4. A boot according to claim 3, wherein:

said reinforcement element includes at least one arm surrounding the rear region of the user's foot.

5. A boot according to claim 3, wherein:

said strip-shaped reinforcement element includes at least one reinforcement arm directed forwardly towards said forward end of said bottom assembly.

6. A boot according to claim 5, wherein:

said at least one reinforcement arm directed forwardly towards said forward end of said bottom assembly at least partially surrounds a fore region of the user's foot.

7. A boot according to claim 3, wherein:

said reinforcement element is provided with a substantially vertical tab extending downwardly toward said bottom assembly in said rear region of said bottom assembly, said vertical tab having a downwardly extending free end; and a free space being located, in a rest position of the boot, between said free end of said tab and said bottom assembly so as to determine a bending freedom of a heel area of said bottom assembly with respect to said reinforcement element.

8. A boot according to claim 1, wherein:

said reinforcement element extends continuously along said one side of said upper to a second side of said of said upper while outlining the rear region of the user's foot.

9. A boot according to claim 1, further comprising:

hooking means on said reinforcement element for cooperating with a retention and closure system of the boot on the user's foot.

10. A boot according to claim 1, wherein:

said core layer includes cut-outs at selected points, so as to ensure direct communication between said wearable layer and said comfort layer.

11. A boot according to claim 1, further comprising:

a further reinforcement element, generally stirrup-shaped, pivotally mounted on said reinforcement element coupled to said core layer;

said further reinforcement element extending onto an upper portion of said upper of the boot while surrounding the rear region of the user's foot.

12. A boot comprising:

an upper having a pair of opposite sides;

a bottom assembly secured to said upper, said bottom assembly including a forward end, a rearward end, and an intermediate region between said forward end and said rearward end, said bottom assembly comprising a plurality of layers including:

at least one wearable layer for contact with the ground;

at least one core layer attached to said wearable layer to provide stiffness for said bottom assembly; and an elastic comfort layer positioned on said at least one core layer to provide for shock-absorption;

a reinforcement element for reinforcing the upper, said reinforcement element being coupled to said core layer of said bottom assembly in said intermediate region, said reinforcement element extending from said intermediate region along at least one of said pair of sides of said upper to said rearward end of said bottom assembly, said reinforcement element being spaced from said bottom assembly at areas between said intermediate region and said rearward end.

13. A boot according to claim 12, wherein:

said reinforcement element being positioned against but not being fixed to said at least one of said pair of sides of said upper.

14. A boot according to claim 12, wherein:

on at least one of said sides of said upper, said reinforcement element has a shape of a strip, said strip extending substantially parallel to said bottom assembly to said rear region.

15. A boot comprising:

an upper having a pair of opposite lateral sides;

a bottom assembly secured to said upper, said bottom assembly including a forward end, a rearward end, and an intermediate region between said forward end and said rearward end, said bottom assembly comprising a plurality of layers including:

at least one wearable layer for contact with the ground;

at least one core layer attached to said wearable layer to provide stiffness for said bottom assembly; and an elastic comfort layer positioned on said at least one core layer to provide for shock-absorption; and means for laterally stiffening the boot without disturbing said shock-absorption of said elastic comfort layer, said means comprising at least one reinforcement element for reinforcing the upper, said reinforcement element being coupled to said core layer of said bottom assembly in said intermediate region, said reinforcement element extending from said intermediate region along at least one of said pair of sides of said upper to said rearward end of said bottom assembly, said reinforcement element being spaced from said bottom assembly at areas between said intermediate region and said rearward end.

16. A boot according to claim 15, wherein:

said reinforcement element being positioned against but not being fixed to said at least one of said pair of sides of said upper.

17. A boot according to claim 15, wherein:

on at least one of said sides of said upper, said reinforcement element has a shape of a strip, said strip extending substantially parallel to said bottom assembly to said rear region.

* * * * *